United States Patent [19]

Vilen

[11] 4,313,451

[45] Feb. 2, 1982

[54] APPARATUS FOR WASHING SOILED ARTICLES

[75] Inventor: Erik O. Vilen, LaGrange Park, Ill.

[73] Assignee: G. S. Blakeslee & Company, Chicago, Ill.

[21] Appl. No.: 75,406

[22] Filed: Sep. 14, 1979

[51] Int. Cl.[3] ..... B08B 3/02

[52] U.S. Cl. ..... 134/47; 134/52; 134/72

[58] Field of Search ..... 134/47, 48, 52, 72

[56] References Cited

U.S. PATENT DOCUMENTS

| | | | |
|---|---|---|---|
| 1,512,918 | 10/1924 | Forsgard | 134/48 X |
| 2,864,387 | 12/1958 | Federighi et al. | 134/48 X |
| 2,884,935 | 5/1959 | Fox | 134/72 |
| 2,949,120 | 8/1960 | Federighi | 134/48 X |
| 3,319,637 | 5/1967 | Gore et al. | 134/72 X |
| 3,800,813 | 4/1974 | Noren | 134/52 X |
| 4,147,559 | 4/1979 | Fraula et al. | 134/57 D |

*Primary Examiner*—Robert L. Bleutge

*Attorney, Agent, or Firm*—Emrich, Root, Lee, Brown & Hill

[57] ABSTRACT

A dishwashing machine includes a plurality of sections through which a soiled article to be washed is transported. A dishwashing machine includes a detergent pre-wash section, a detergent-wash section, a chemical power rinse and final clear water rinse section.

10 Claims, 1 Drawing Figure

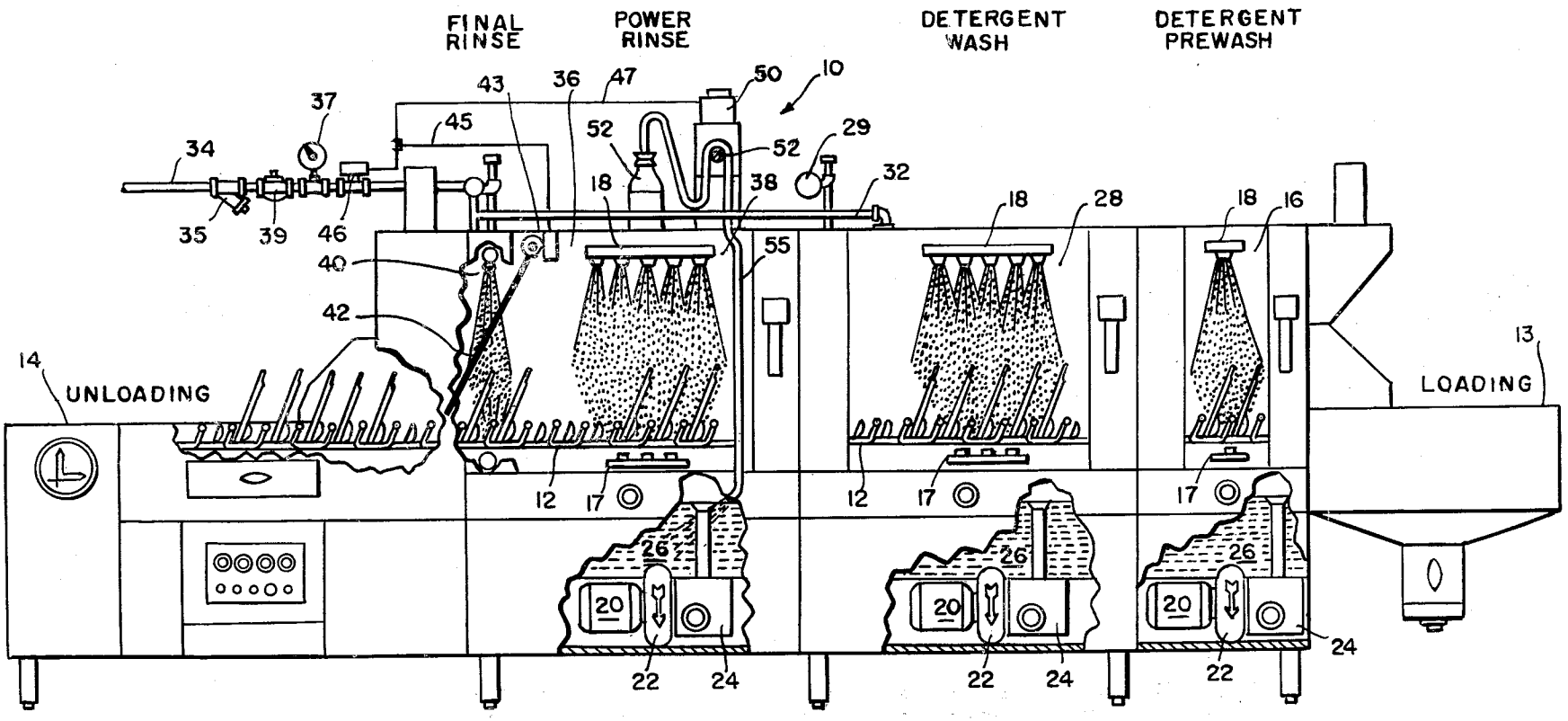
LOADING
DETERGENT PREWASH
DETERGENT WASH
POWER RINSE
FINAL RINSE
UNLOADING
10
12
13
14
16
17
18
20
22
24
26
28
29
32
34
35
36
37
38
39
40
42
43
45
46
47
50
52
55

APPARATUS FOR WASHING SOILED ARTICLES

BACKGROUND OF THE INVENTION

Recently, dishwashing machines have been developed for use in commercial dishwashing operations which comprise a detergent pre-wash section, a detergent wash section and a sanitizing chemical rinse section. Also, U.S. Patent 3,565,239, assigned to the assignee of the present invention, describes a continuous operating dishwashing machine having pre-wash, wash and power rinse sections which are heat sanitizing type devices. Although such devices clean and sanitize the articles washed, the exiting washed articles either contain a film of chemical agents thereon which are necessary to kill bacteria and the like and sanitize the washed articles or are impractical from a cost standpoint. Such chemical films, although not harmful to the user, have limited the widespread application of such dishwashers and has severely restricted the use of higher concentrations of chemical agents to sanitize the dishes or articles as well as the application of specific stronger acting chemicals necessary to kill bacteria growth and the like. Moreover, such chemical films provide a taste to the article and are harmful to silver and pewter articles by chemically acting thereon.

SUMMARY OF THE INVENTION

Accordingly, it is one object of the present invention to provide a dishwashing machine containing pre-wash, wash, chemical power rinse and clear water rinse sections.

The dishwashing machine or apparatus of the present invention is comprised of a conveyor element passing through a plurality of housings in which a detergent pre-wash, detergent-wash, chemical power rinse and final rinse operations on the soiled article to be washed is effected. The conveyor element includes a loading section for trays or soiled articles onto the conveyor element as well as an unloading section for removing the washed dishes therefrom. The conveyor element is comprised of a series of conveyor sections which extend the length of the dishwashing apparatus and which present upper supporting surfaces in a single unobstructed plane whereby a rack or the soiled article to be washed may be positioned along the conveyor element. Thus, dishes and the soiled articles, placed directly upon the conveyor, are passed through the plurality of housings or sections of the machine.

The dishwashing machine may include a first detergent pre-wash housing or section having conventional lower and upper spray boxes which sprays or jets water or washing solution upwardly and downwardly onto the soiled article as the soiled dishes or article to be washed is passed through the detergent pre-wash section. The detergent-wash section also includes lower and upper spray boxes which sprays or jets water or washing solution upwardly and downwardly onto the soiled dishes or articles as the same are passed through the detergent wash housing. Each of the detergent-wash and detergent pre-wash sections include in the base thereof a pumping assembly comprised of an electric motor, a rotary impellor pump driven by the motor and having an outlet connected to the spray boxes for delivering liquid under pressure to wash the soiled articles or dishes and a sump chamber which communicates with the bottom of the housing and with the inlet of the pump for supplying liquid to the pumping assembly.

After the detergent wash section of the machine, a chemical sanitizing power rinse and clear water rinse is provided which includes a chlorine dispenser operatively connected to a motor pump assembly to predeterminely control the concentration of the chlorine chemical within the sanitizing power portion of the rinse section. The sanitizing power rinse portion includes lower and upper spray boxes operatively connected to the motor pump assembly mounted in a tank and having an electric motor, a rotary lower pump and an outlet connected to the spray boxes. A sump chamber communicates with the bottom of the tank and with the inlet of the pump for supplying liquid thereto. The chlorine dispenser element is operatively timed and controlled to inject a specific concentration of the sanitizing chemical into the heated water rinse tank to thereby predeterminely control and maintain the chemical concentration of the chemical power rinse portion of the final rinse section.

The motor pump unit for the sanitizing power rinse portion is mounted within the bottom wall of the tank which receives its supply of fresh water from the final clear water rinse portion which is operable when the chemically cleansed article triggers a switch mechanism which energizes a solenoid to direct fresh water at about 120° F. through the lower and upper spray boxes to finally rinse the washed article with clear water. The use of clear water to finally rinse the washed articles supplies clear water to the tank such that the concentration of the chemical in the power rinse may be to determinely controlled and maintained at a level of approximately 50 parts per million chemical through the clear final rinse.

The power rinse tank preferably includes a heater element to maintain a minimum temperature of at least 120° F. in the power rinse section.

The solenoid is electrically connected to a timing element which is operatably connected to the chemical chlorine dispenser. The timer may be a one minute timer which predeterminely controls the dispensing of the chlorine chemical into the power rinse tank to thereby control the concentration of the chemical in the final rinse power tank. Because the final rinse rate is known and the amount of fresh water going into the rinse tank is known, the concentration of the chemical in the final rinse tank is maintained at a specific concentration sufficient to control and kill bacteria and the like and sanitize the washed article.

By utilizing a fresh water final rinse after the sanitizing chemical power rinse, the chemical film on the washed article is effectively removed thereby eliminating any unpleasant chemical odors or taste on the washed article. Additionally, the novel method of utilizing a clear water final rinse permits the use of the apparatus to wash and sanitize silver and pewter type articles which would be damaged by the chemical power rinse.

DESCRIPTION OF THE DRAWINGS

FIG. 1 is a side-elevational view of the dishwashing apparatus and method of washing articles in accordance with the present invention.

DESCRIPTION OF THE INVENTION

Referring now to the only drawing FIGURE there is shown a dishwashing machine or apparatus 10 which is comprised of a conveyor element or means 12 passing through a plurality of housings or sections, as will hereinafter be described. The conveyor element 12 includes a loading section 13 for depositing trays, dishes or soiled articles onto the conveyor means and an unloading section 14 for removing the washed and sanitized trays, dishes or articles from the conveyor means. Although the conveyor means 12 is shown as a linear conveyor section, it is within the scope of this invention that the conveyor means include a series of interconnecting sections which form a continuous conveyor means arranged horizontally which may be in the form of an oval contingous conveyor means. See for example U.S. Pat. No. 3,565,239, assigned to the assignee of the present invention, for a description of the type of conveyor means useful in the present invention. The conveyor element 12 is comprised of a series of conveyor sections which extend the length of the dishwashing apparatus 10 and which present a supporting surface in a single unobstructed plane whereby a rack, dish or article to be washed may be positioned along the conveyor element and passed through the dishwashing apparatus 10.

The dishwashing machine or apparatus 10 may include a first detergent pre-wash housing or section 16 having conventional lower and upper spray boxes, 17 and 18 respectively, which sprays or jets water or washing solution upwardly and downwardly onto the soiled tray, dish or article as the same are passed through the detergent pre-wash section 16. The detergent pre-wash section includes in the base thereof a pumping assembly comprised of an electric motor 20, a rotary impeller pump 22 driven by the motor and having an outlet connected to the lower and upper spray boxes (17 and 18) for delivering liquid under pressure to the spray boxes. A sump chamber 24 communicates with the bottom or tank 25 of the detergent pre-wash housing or section 16, and with the inlet of the pump 22 for supplying liquid thereto. Although the dishwashing machine or apparatus 10 has been described as having a detergent pre-wash housing or section 16, it is within the scope and content of the present invention that the apparatus contain only a detergent washing section, as will hereinafter be described.

The dishwashing apparatus 10 further includes a main detergent wash housing or section 28, positioned adjacent the pre-wash section 16, having a conventional lower and upper spray boxes, 17 and 18 respectively, which sprays or jets water and washing solution at a temperature of 155° F. upwardly and downwardly onto the soiled tray, dish or article as the same are passed through the main detergent wash section 28. The main detergent wash section includes in the base thereof a pumping assembly comprised of an electric motor 20, a rotary impeller pump 22 driven by the motor and having an outlet connected to the lower and upper spray boxes for delivering wash detergent liquid under pressure to the spray boxes. Additionally, a sump chamber 24 communicates with the base or tank 25 of the detergent wash section 28 and with the inlet of the pump 22 for supplying liquid thereto. Although it is not shown, a heater is positioned within the tank 26 of the detergent wash section 16 to maintain the temperature of the detergent wash liquid at 155° F. A valve 29 operatively connected to an external source of detergent 30 permits manual filling of the tank 26 with a detergent wash solution. A makeup line 32 is operatively connected to a water inlet 34 to maintain a predetermined supply of detergent wash solution in the detergent wash section 16, as desired.

As shown in the FIGURE a final chemical sanitizing power rinse and clear water rinse housing or section 36 is positioned adjacent the main detergent section 28 and is comprised of a chemical sanitizing power rinse portion 38 and a clear water rinse portion 40. The chemical sanitizing power rinse portion 38 includes lower and upper spray boxes, 17 and 18 respectively, which sprays or jets a chemical sanitizing liquid upwardly and downwardly onto the washed trays, dishes or articles as the same are passed through the chemical sanitizing power rinse portion.

Additionally, mounted within the final sanitizing power rinse section 36 is a clear water rinse portion 40 having lower and upper spray boxes, 17 and 18 respectively, which sprays or jets clear water at a temperature of approximately 120° F. onto the chemically sanitized trays, dishes or articles and to remove the chemical from the washed articles and to eliminate the odors therefrom. Positioned below the chemical sanitizing power rinse portion 38 and the clear water rinse portion 40 is a tank 26 having an electric motor 20, a rotary impeller pump element 22 and an outlet connected to the spray boxes 17 and 18 of the chemical sanitizing chemical power rinse portion 28, A sump chamber 25 communicates with the tank 26 and with inlet of the pump for supplying chemical sanitizing liquid to the power rinse portion 38.

The motor pump unit for the chemical sanitizing power rinse portion 38 receives its supply of fresh water from the final clear water rinse portion 40 which is energized when the chemically sanitized trays, dishes or articles engage a rinse gate number 42 operatively connected to a rinse switch 43 which is electrically connected by line 45 to a solenoid valve 46 positioned in the water inlet line 34. As the trays, dishes or articles engage the rinse gate 42, the rinse switch 43 is engaged and the solenoid valve 46 is energized to permit clean water, at a 120° F. temperature to be directed through the lower and upper spray boxes 17 and 18 respectively, to finally rinse the chemically sanitized trays, dishes and articles with clear water to remove the chemical therefrom and to eliminate the unpleasant chemical odors from the washed article. The spent clear water used in the clear water rinse portion 40 is directed into the tank 26 to thereby supply the chemical sanitizing power rinse portion with clear water. Preferably, tank 26 includes a heater therein to maintain the temperature of the chemical sanitizing power liquid at 120° F. When the solenoid valve 46 in energized, and electric impulse passes by and through electric line 47 to a timing element 50 which is operatably connected to a chemical dispenser pump 52 to draw predetermined amounts of chemical or chlorine from the chemical container 54 through the chemical dispenser pump 52 and out chemical tube 55 into tank 26 in the bottom of the chemical sanitizing power rinse and clear water rinse housing 36.

When the timing element 50 preferably is used on a one minute timing basis, the element 50 provides a signal to the chemical dispenser sufficient amounts of chemicals into rinse tank 26 to provide and maintain a concentration of at least 50 ppm chemical in the clear water. Because the timing element 50 is actuated only when the solenoid is energized, and because the rinse rate is known for the clear water rinse portion 40, the amount of fresh water delivered into the tank 20 is known. Thus, the timing element 50 and chemical pump 52 may be adjusted to maintain a predetermined concentration of the chemical in the sanitizing power rinse portion, as is desired.

Additionally, a strainer 35, a pressure gage 37 and a pressure regulating valve 39 may be inserted into the water inlet line 34 to aid in regulating and controlling the flow of the clear water into the clear water rinse portion 40, as is well known in the art. Although it is not shown, a float control means cooperates with the tank 26 in the sanitizing power rinse and clear water rinse housing 36 to maintain a predetermined amount of clear water therein. Such a float control means is operatably connected to rinse switch 43 to permit clear water to be directed into tank 26 to maintain the amount of chemical sanitizing power rinse solution for the apparatus 10.

Importantly, it has been found that the sanitizing of the washed articles is done by the chemical sanitizing power rinse portion 38 and the clear water temperature necessary in the clear water rinse portion 40 does not have to be maintained at 120° F. Additionally, it has been found that by utilizing a fresh water final rinse after the chemical sanitizing power rinse, the chemical film on the washed article has been completely removed and the unpleasant chemical odor or taste on the washed article has been eliminated. Moreover, the novel method of utilizing a clear water final rinse permits the use of dishwashing apparatus in accordance with the present invention having a chemical sanitizing portion to wash silver and pewter type articles which would be damaged by the chemical power rinse.

I claim:

1. An apparatus for washing soiled articles and having a conveyer means movable therethrough, including in combination;

a first detergent wash section adapted to direct a detergent wash solution onto the exposed articles positioned on the conveyor means to wash the same;

a second chemical sanitizing power rinse section adapted to direct a chemical sanitizing solution onto the exposed washed articles positioned on the conveyor means to chemically sanitize the same, and a third clear fresh water final rinse section adapted to direct clear water onto the exposed chemically sanitized articles to remove the chemical therefrom and provide chemical-free cleaned articles.

2. The apparatus in accordance with claim 1 further including a detergent pre-wash section adapted to direct a pre-wash solution onto the soiled articles positioned on the conveyor means prior to engagement of the soiled articles with said detergent wash section.

3. The apparatus in accordance with claim 1 wherein each of said detergent wash section and said chemical power rinse section include a pumping assembly comprised of an impeller pump member driven by a drive motor to circulate the respective solutions onto the exposed articles.

4. The apparatus in accordance with claim 1 wherein each of said detergent wash section, said chemical sanitizing power rinse section and said clear water final rinse section include lower and upper spray boxes therein respectively for directing said wash, said chemical sanitizing and said clear water solution onto the exposed articles.

5. The apparatus in accordance with claim 1 wherein said chemical sanitizing solution is maintained at a temperature of about 120° F.

6. The apparatus in accordance with claim 1 wherein said clear water final rinse section includes switch means engageable with the sanitized articles on the conveyor means to energize and operate said clear water final rinse section to direct clear water onto the exposed sanitized articles to remove the chemical therefrom.

7. The apparatus in accordance with claim 6 wherein said switch means includes a rinse gate engageable with the sanitized article and operatively connected to a switch which energizes a solenoid element to direct clear water through said clear water final rinse section.

8. The apparatus in accordance with claim 1 wherein said sanitizing power rinse section includes pumping means operatively connected to a chemical supply means to supply chemical to said sanitizing power rinse section.

9. The apparatus in accordance with claim 8 further including control means engageable with said pumping means to energize the same to control the flow of chemical to said sanitizing power rinse section.

10. The apparatus in accordance with claim 9 wherein said control means includes a timing element to predeterminely control the flow of chemical to said sanitizing power rinse section.

* * * * *